US009157254B1

(12) United States Patent
Rogers et al.

(10) Patent No.: US 9,157,254 B1
(45) Date of Patent: Oct. 13, 2015

(54) WINDOW LOCK AND METHOD

(71) Applicants: Christopher R. Rogers, Winston Salem, NC (US); Farrell D. Smith, Sophia, NC (US)

(72) Inventors: Christopher R. Rogers, Winston Salem, NC (US); Farrell D. Smith, Sophia, NC (US)

(73) Assignee: Hughes Supply and Manufacturing Company of Thomasville, Inc., Thomasville, NC (US)

( * ) Notice: Subject to any disclaimer, the term of this patent is extended or adjusted under 35 U.S.C. 154(b) by 66 days.

(21) Appl. No.: 13/654,867

(22) Filed: Oct. 18, 2012

(51) Int. Cl.
*E05C 3/04* (2006.01)
*E05B 9/02* (2006.01)
*E05B 9/08* (2006.01)

(52) U.S. Cl.
CPC . *E05B 9/02* (2013.01); *E05B 9/082* (2013.01); *E05C 3/046* (2013.01); *Y10S 292/20* (2013.01); *Y10S 292/47* (2013.01)

(58) Field of Classification Search
CPC ..... E05B 9/02; E05B 9/082; E05B 63/20; E05B 65/0864; E05C 1/10; E05C 3/046; E05C 2007/007; Y10S 70/57; Y10S 292/47; Y10S 292/20
USPC ..... 70/89, 90, 232, 451, DIG. 57; 292/240, 292/241, 242, DIG. 20, DIG. 47
See application file for complete search history.

(56) References Cited

U.S. PATENT DOCUMENTS 4,790,582 A 12/1988 Keast ..... 292/288
5,139,291 A 8/1992 Schultz ..... 292/42
5,219,195 A 6/1993 Lawrence ..... 292/336.3
5,248,174 A 9/1993 Matz et al. ..... 292/338
5,536,052 A 7/1996 Maier ..... 292/63
5,669,180 A 9/1997 Maier ..... 48/181
5,669,639 A 9/1997 Lawrence ..... 292/175
5,970,656 A 10/1999 Maier ..... 49/181
5,996,283 A 12/1999 Maier ..... 19/181
6,068,306 A 5/2000 Brautigam ..... 292/242
6,142,541 A 11/2000 Rotondi ..... 292/241
6,364,375 B1 4/2002 Szapucki et al. ..... 292/63
6,412,834 B1 * 7/2002 Waitai et al. ..... 292/197
6,450,554 B1 9/2002 Rotondi et al. ..... 292/158
6,484,444 B1 11/2002 Polowinczak ..... 49/449
6,568,723 B2 5/2003 Murphy et al. ..... 292/241
6,634,683 B1 * 10/2003 Brannan ..... 292/241
6,767,038 B1 7/2004 Huml ..... 292/158
6,854,214 B2 2/2005 Polowinczak ..... 49/449
6,871,886 B2 3/2005 Coleman et al. ..... 292/241
7,000,957 B2 2/2006 Lawrence ..... 292/241
7,063,361 B1 6/2006 Lawrence ..... 292/241
7,237,811 B1 7/2007 Lawrence ..... 292/39
7,322,620 B1 1/2008 Lawrence ..... 292/242
7,407,199 B2 * 8/2008 Richardson ..... 292/163
7,441,811 B2 10/2008 Lawrence ..... 292/110

(Continued)

*Primary Examiner* — Kristina Fulton
*Assistant Examiner* — Christine M Mills
(74) *Attorney, Agent, or Firm* — Blake P. Hurt; Tuggle Duggins P.A.

(57) ABSTRACT

An attractive window lock for conventional double hung windows is provided with a housing containing a handle and a cam. The housing defines a pair of grooves which are complementary shaped to the ends of a mounting plate. The mounting plate is affixed with fasteners to the window sash and the housing is then slideably joined to the mounting plate, concealing the mounting plate and fasteners and providing an attractive appearance for the owner. A keeper is affixed to the opposing sash and by rotating the handle on the housing the rotatable cam extends and engages the keeper to secure the sashes in place.

7 Claims, 6 Drawing Sheets

(56) References Cited

U.S. PATENT DOCUMENTS

| | | | | |
|---|---|---|---|---|
| 7,520,541 | B1 | 4/2009 | Lawrence | 292/175 |
| 7,588,271 | B1 | 9/2009 | Lawrence | 292/241 |
| 7,658,035 | B1 | 2/2010 | Lawrence | 49/185 |
| 7,922,223 | B2 | 4/2011 | Lawrence | 292/241 |
| 8,186,102 | B1 | 5/2012 | Lawrence | 49/185 |
| 8,333,413 | B2 * | 12/2012 | Bourgoin et al. | 292/164 |
| 2004/0207212 | A1 * | 10/2004 | Wallis | 292/241 |
| 2004/0256863 | A1 * | 12/2004 | Tsai | 292/165 |
| 2004/0262929 | A1 | 12/2004 | Trickel | 292/241 |
| 2008/0169658 | A1 * | 7/2008 | Wolf | 292/241 |
| 2010/0218425 | A1 * | 9/2010 | Nolte et al. | 49/185 |

* cited by examiner

WINDOW LOCK AND METHOD

FIELD OF THE INVENTION

The invention herein pertains to window locks as used on double hung and other windows and particularly pertains to a window lock having a mounting plate which is slideably received within the housing to conceal the mounting fasteners.

DESCRIPTION OF THE PRIOR ART AND OBJECTIVES OF THE INVENTION

Window hardware has become an increased focal point of decorators and designers in recent years. Large, bulky, unattractive window hardware has for the most part been replaced with more attractive hardware having modern lines and a pleasing appearance. Unsightly hardware is undesirable, and functional mechanical appearances are no longer in vogue.

Thus, in view of the above mentioned concerns, the present invention was conceived and one of its objectives is to provide an attractive window lock which can be easily installed at a factory or job site.

It is another objective of the present invention to provide an attractive window lock which includes a detachable mounting plate.

It is still another objective of the present invention to provide a window lock with a grooved housing for slideable assembly with a mounting plate.

It is yet another objective of the present invention to provide a window lock having a mounting plate for supporting a housing which contains a cam, a latch and a handle for use in safely securing a window.

It is a further objective of the present invention to provide a window lock and method of mounting for precut double hung windows.

It is still a further objective of the present invention to provide a window lock having a detachable mounting plate for quick and easy assembly.

It is yet a further objective of the present invention to provide a window lock formed of conventional materials such as metals or plastics.

Various other objectives and advantages of the present invention will become apparent to those skilled in the art as a more detailed description is set forth below.

SUMMARY OF THE INVENTION

The aforesaid and other objectives are realized by providing a window lock consisting of a housing which is slideably assembled with a mounting plate. The mounting plate includes a pair of openings for receiving screws, bolts or other fasteners for attachment to, for example the upper rail of a bottom window sash of a double hung window. The mounting plate has a thin center planar section and an opposing pair of ends which present somewhat of a U-shape. The ends are generally rectangular with extended faces at the front and include openings therein for receiving the mounting fasteners. During assembly the mounting plate is affixed to a sash rail by fasteners positioned within the openings of the ends. The housing is then aligned with the mounting plate whereby the ends of the mounting plate engage a U-shaped groove formed within the housing for slideably joining and completely concealing the mounting plate. Finger rotation of the handle causes the cam contained within the housing to extend to engage a keeper which is typically mounted in the lower rail of the opposing upper window sash when the sashes are aligned and the window closed. When assembled on a double hung window the housing conceals the mounting screws contained within the mounting plate for a more pleasant, aesthetic appearance. During lock replacement the housing can be slidably detached from the mounting plate to reveal the mounting screws for access and replacement as needed.

An alternate embodiment of the mounting plate includes an opposing pair of ends each having an opposing pair of extended faces.

DETAILED DESCRIPTION OF THE PREFERRED EMBODIMENT AND OPERATION OF THE INVENTION

Figure 1:
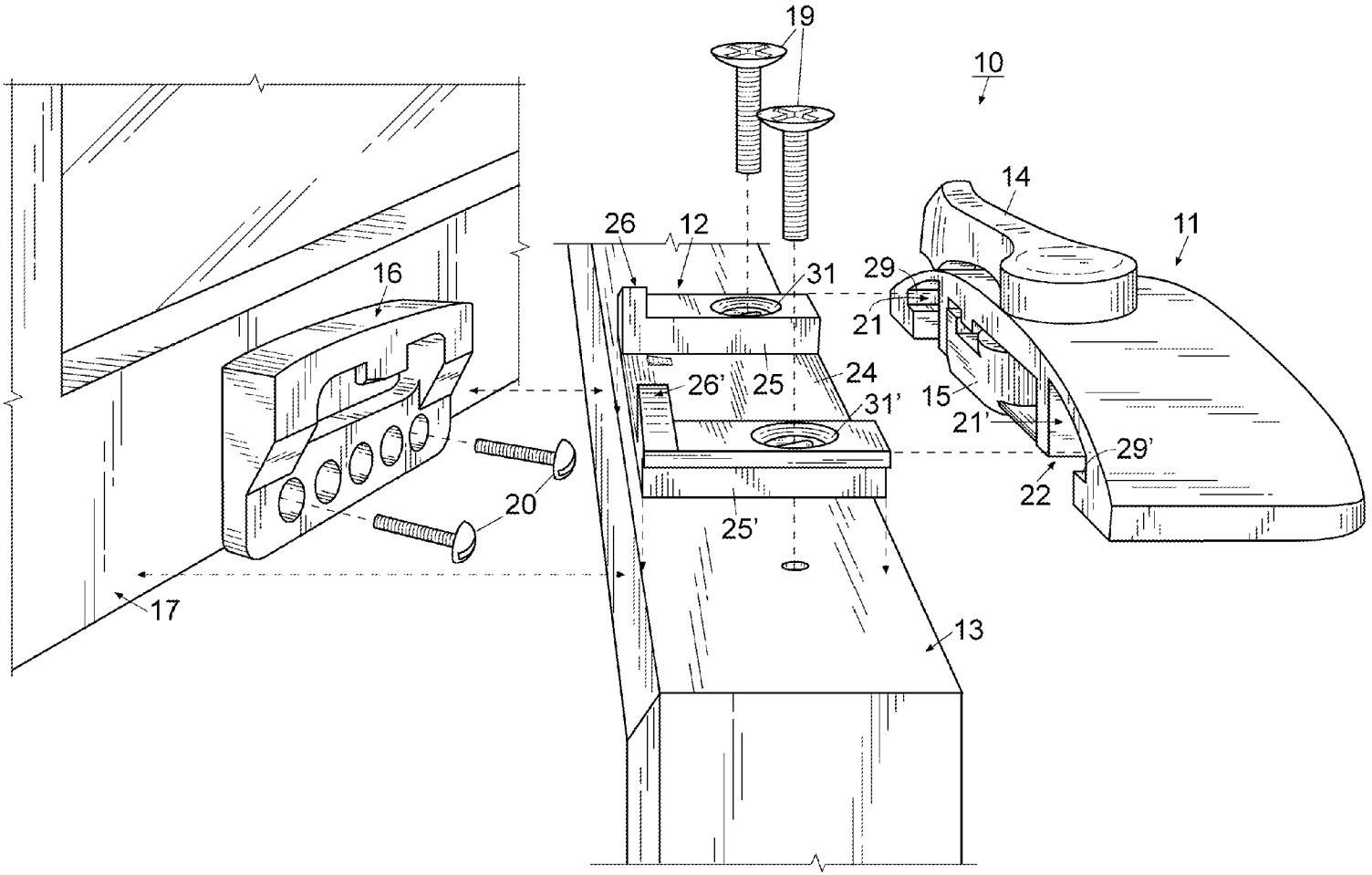
FIG. 1 shows a schematic perspective representation of the window lock of the invention in exploded fashion.

For a better understanding of the invention and its operation, turning now to the drawings, preferred window lock 10 is schematically shown exploded in FIG. 1 with housing 11 removed from mounting plate 12 seen above fragmented window sash 13. Sash 13 may be for example the upper rail of a bottom hung window sash of a conventional double hung window (not shown). Window lock housing 11 includes conventional handle 14 which is connected to cam 15 contained therein. As usual, handle 14 is manually rotatable to turn cam 15 which will engage keeper 16 shown prior to mounting on fragmented window sash 17. Sash 17 may be for example the lower rail of a top hung window sash of a conventional double hung window (not shown). Fasteners 19 consist of screws for attaching mounting plate 12 to sash 13 whereas fasteners 20 consist of screws for attaching keeper 16 to sash 17. As would be understood, while screws are depicted herein for mounting purposes, bolts, nails or other fasteners may also be used depending on the particular materials available and mounting procedures desired. Window sashes are typically formed from polyvinyl chloride (PVC) although other plastics, metals and wood are also used.

Figure 2:
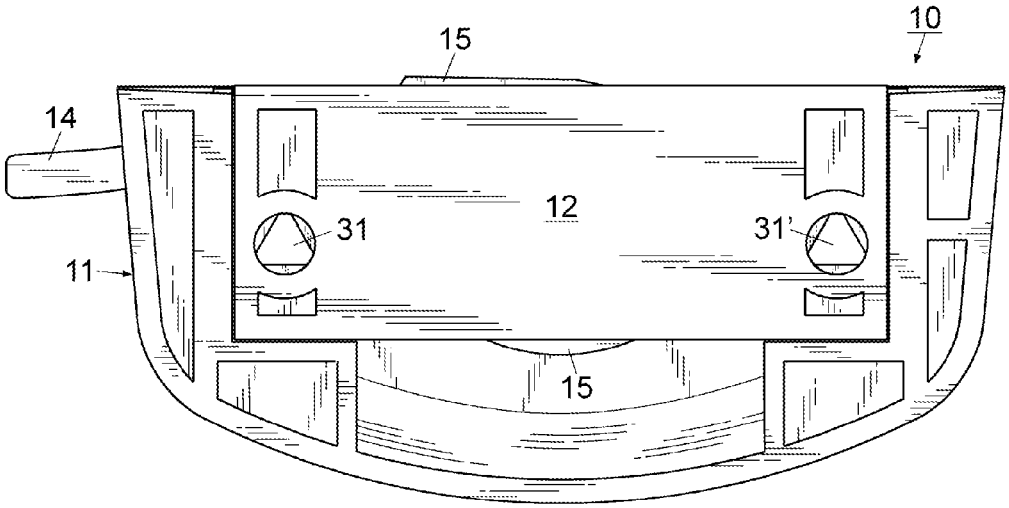
FIG. 2 pictures a bottom plan view of the window lock as seen in FIG. 1 assembled.
Figure 3:
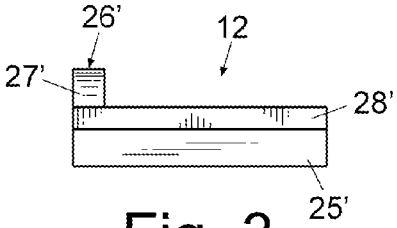
FIG. 3 depicts a right side elevational view of the mounting plate as removed from the window lock housing, the left side elevational view being a mirror image thereof.
Figure 4:
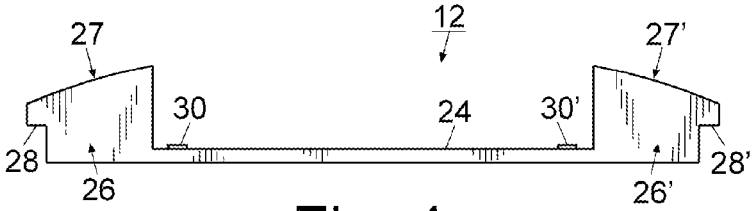
FIG. 4 demonstrates a front elevational view of the mounting plate seen in FIG. 3.
Figure 5:
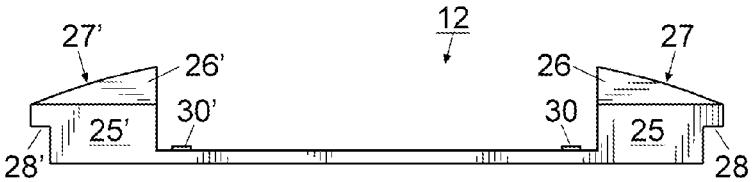
FIG. 5 depicts a rear elevational view of the mounting plate seen in FIG. 3.
Figure 8:
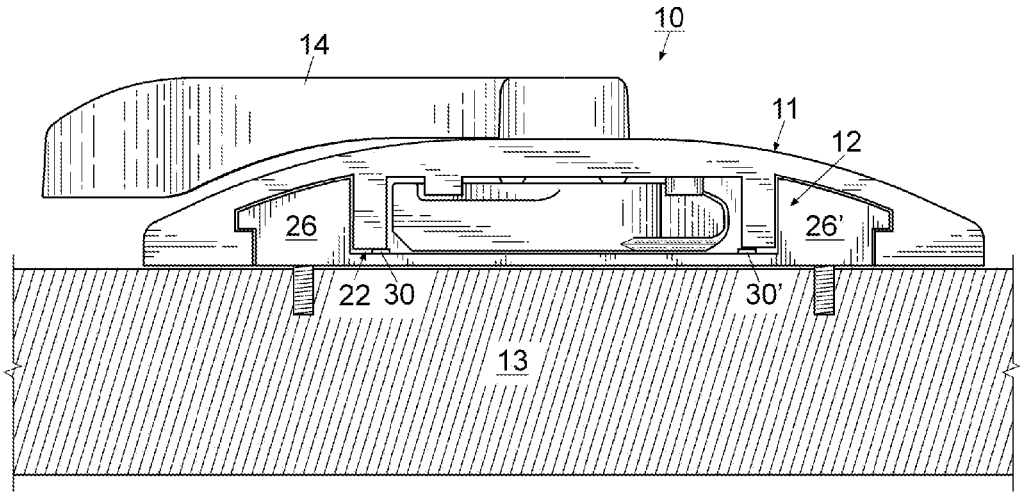
FIG. 8 schematically shows the assembled window lock as mounted on the top rail of a bottom window sash.
Figure 9:
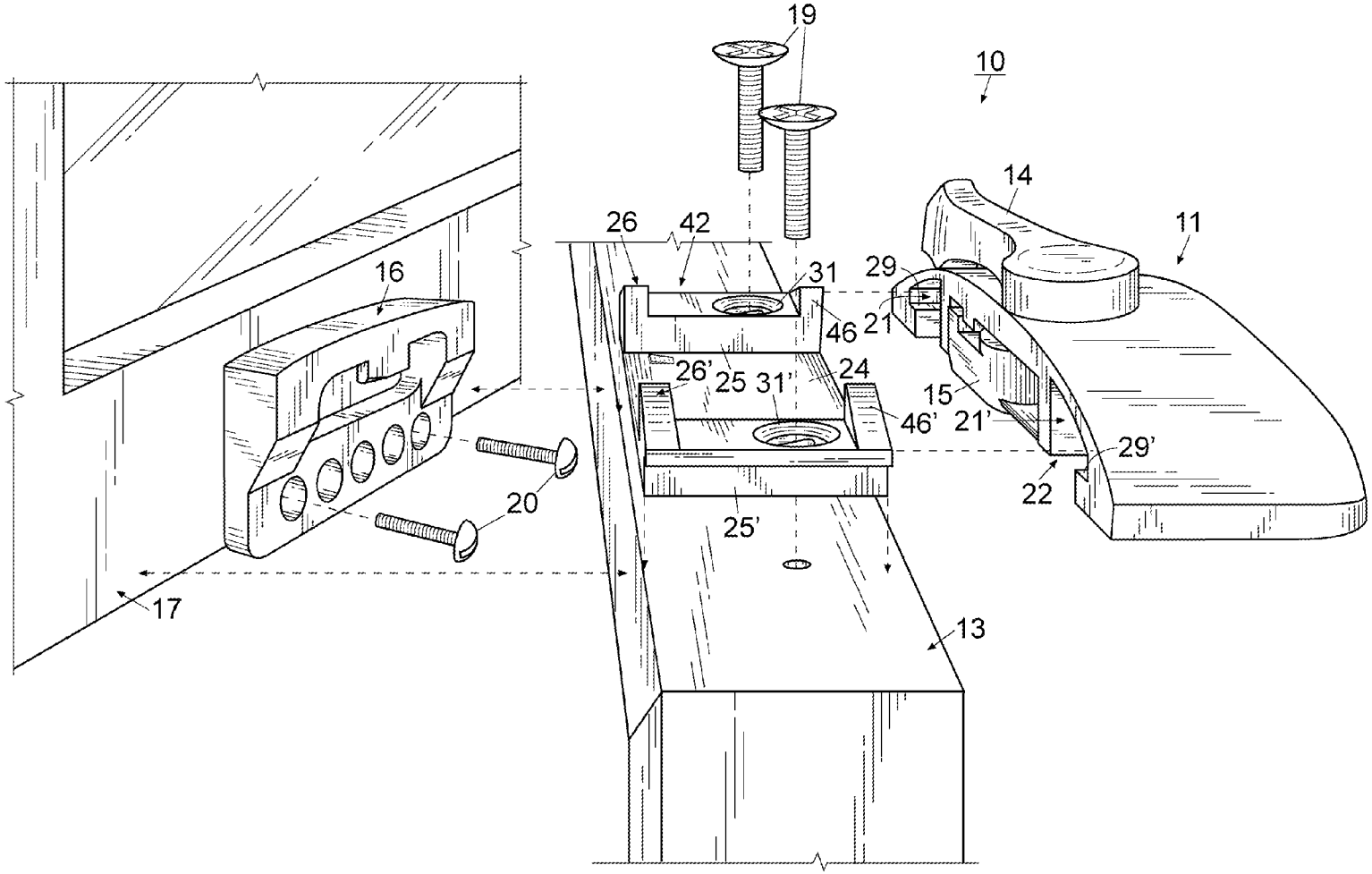
FIG. 9 shows an alternate embodiment of the mounting plate.
Figure 10:
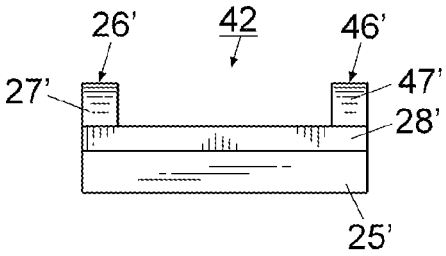
FIG. 10 depicts a right side elevational view of the mounting plate as shown in FIG. 9.
Figure 11:
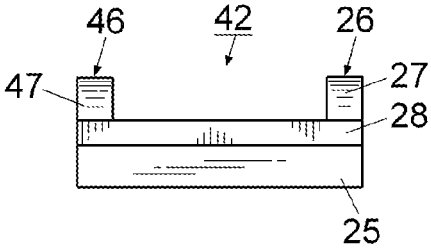
FIG. 11 pictures the left side elevational view of the mounting plate as shown in FIG. 9.
Figure 12:
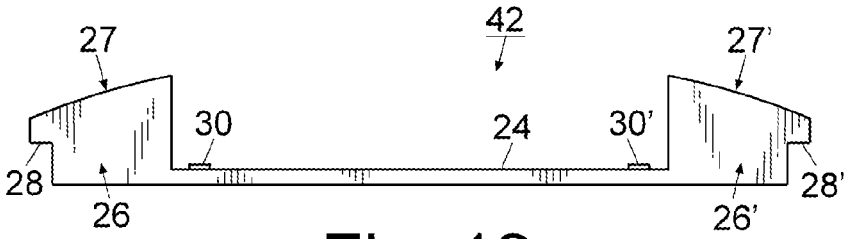
FIG. 12 demonstrates a front elevational view of the mounting plate seen in FIG. 10.
Figure 13:
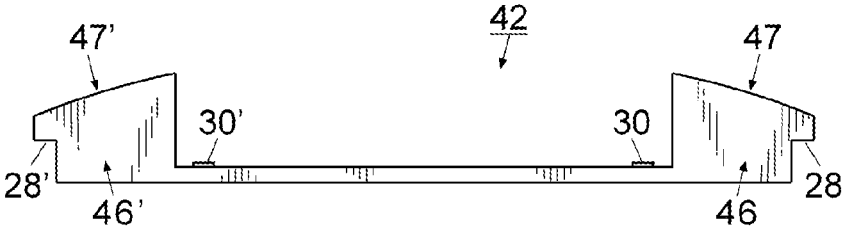
FIG. 13 depicts a rear elevational view of the mounting plate seen in FIG. 10.
Figure 14:
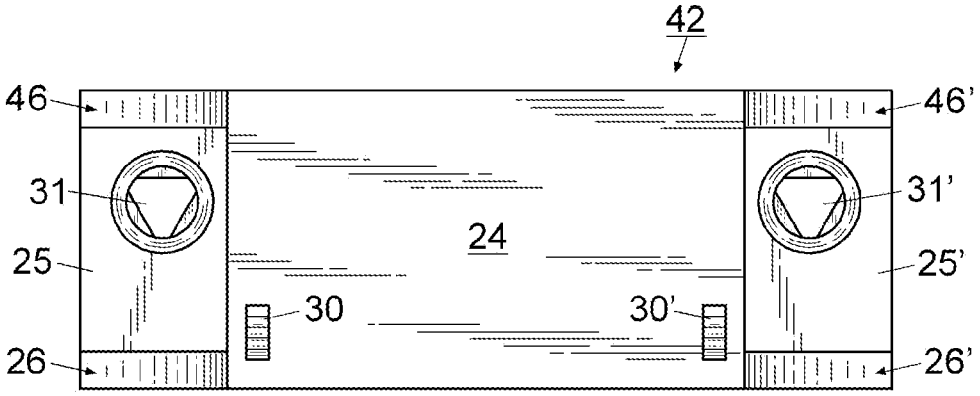
FIG. 14 illustrates a top plan view of the mounting plate seen in FIG. 12.
Figure 15:
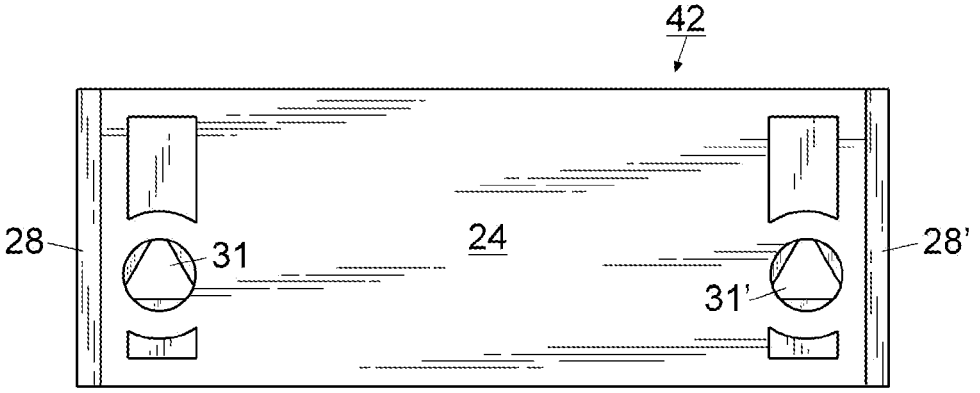
FIG. 15 features a bottom plan view of the mounting plate seen in FIG. 13.

As shown in FIGS. 1 and 8, housing 11 defines somewhat of a U-shaped groove 22 best seen in FIG. 8 for receiving U-shaped mounting plate 12. U-shaped groove 22 includes a pair of slots 21, 21' and an open bottom as seen in FIGS. 1 and 2 and is sized to receive mounting plate 12 which includes flat planar section 24 (FIG. 4). As seen in FIGS. 3, 4, 5, 6 and 7, mounting plate 12 includes a pair of rectangular shaped ends 25, 25' having respectively shoulders 28, 28' and extended biased faces 26, 26' attached thereto. Ends 25, 25' include respectively fastener openings 31, 31' for receiving fasteners 19 as shown in FIG. 1. As seen in FIGS. 4 and 5, faces 26, 26' extend above respectively rectangular ends 25, 25' and shoulders 28, 28' and include respectively biased top surfaces 27, 27'. As seen in FIG. 8, slots 21, 21' of U-shaped groove 22 are shaped complementary to biased faces 26, 26' for easily positioning and slideably mounting housing 11 overtop mounting plate 12. Shoulders 28, 28' are formed along the exterior sides of rectangular ends 25, 25' and slideably engage respectively ledges 29, 29' formed within housing groove 22 as shown in FIG. 1. As would be understood, housing 11 is slideably positioned over mounting plate 12 for concealing mounting plate 12 and fasteners 19 as shown in FIGS. 1 and 8. Planar section 24 includes friction ramps 30, 30' in close proximity to faces 26, 26' of rectangular ends 25, 25'. Friction ramps 30, 30' engage housing 11 as shown in FIG. 8 to insure a snug assembly.

Figure 6:
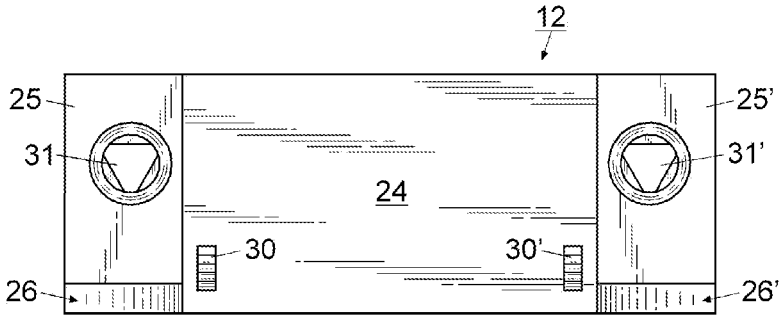
FIG. 6 illustrates a top plan view of the mounting plate seen in FIG. 4.
Figure 7:
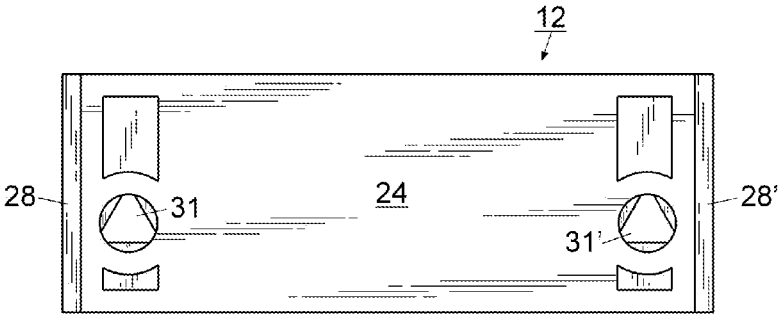
FIG. 7 features a bottom plan view of the mounting plate seen in FIG. 5.

The preferred method of use includes the step of manufacturing preferred window lock 10 including forming housing 11 with open U-shaped groove 22 having ledges 29, 29' as shown in FIG. 1 which is sized to receive mounting plate 12. Mounting plate 12 is formed with a thin central planar section 24 having relatively thick opposing ends 25, 25' with respectively extended faces 26, 26', shoulders 28, 28' and openings 31, 31' as seen for example in FIGS. 3, 4, 5, 6 and 7. Friction ramps 30, 30' are formed on planar section 24 proximate ends 25, 25' as seen in FIG. 6.

During assembly, for example on a conventional double hung window (not shown) the method includes the step of conventionally attaching a keeper such as keeper 16 to an upper sash such as upper sash 17 as shown in FIG. 1 with fasteners 20. Next, mounting plate 12 is positioned in alignment with keeper 16 and affixed to a lower sash such as lower sash 13 by fasteners 19. Window lock housing 11 as shown in FIG. 1 is then positioned and pushed overtop mounting plate 12 whereby U-shaped groove 22 slides over ends 25, 25' of mounting plate 12 and shoulders 28, 28' slide along ledges 29, 29' until housing 11 frictionally engages ramps 30, 30' to insure snug and proper placement as seen in FIG. 8. Thus housing 11 is slideably joined to mounting plate 12 for complete concealment of mounting plate 12 and fasteners 19 joined to sash 13. To secure the double hung window (not shown) handle 14 is rotated as conventional to extend cam 15 for engagement with keeper 16. Once cam 15 engages keeper 16 the double hung window is then locked and secure as usual. Window lock 10 prevents tampering and easy removal as fasteners 19 are hidden and concealed by housing 11. Window lock 10 can be removed, repaired or replaced by reversing the steps discussed above.

An alternate embodiment of mounting plate 12 is shown in FIGS. 9, 10, 11, 12, 13, 14 and 15 by mounting plate 42. As seen in FIGS. 10, 11, 13 and 14 mounting plate 42 includes an additional pair of opposing faces 46, 46' which likewise extend above respectively rectangular ends 25, 25' and shoulders 28, 28' and include respectively biased top surfaces 47, 47'. Mounting plate 42 allows for tighter frictional engagement when engaged with U-shaped groove 22 of housing 11 when mounting plate 12 is fully contained therein as faces 46, 46' engage the rear (not shown) of housing 11 to prevent any possible tilting or wobbling action of housing 11 on mounting plate 42.

The illustrations and examples provided herein are for explanatory purposes and are not intended to limit the scope of the appended claims.

We claim:

1. A window lock comprising: a housing defining a groove with a pair of groove ledges configured to receive a U-shaped mounting plate and a pair of slots, said mounting plate defining a pair of opposing longitudinal ends with rectangular cross-sections for engaging said housing, each longitudinal end comprising a pair of opposing lateral ends relative to said mounting plate and a downwardly extending biased face with a shoulder, each lateral end having a planar terminal face, wherein corresponding planar terminal faces on each longitudinal end are coplanar and parallel, each biased face extending along a longitudinal axis defined by said mounting plate and terminating in a vertical part, each of said housing slots shaped to accommodate different ones of said biased faces, each shoulder extending completely between said opposing lateral ends and beyond said rectangular cross-sectional ends, a cam and a keeper, said cam engaging said keeper, said cam contained within said housing, a handle, said handle connected to said cam for rotating the same, said mounting plate releasably engaging said housing.

2. The window lock of claim 1 further comprising a planar section, said planar section joined to each of said pair of ends, a ramp, said ramp joined atop said planar section.

3. The window lock of claim 1 further comprising a second downwardly extending biased face positioned in opposing relation on each of the lateral ends opposing the other biased faces, said second biased faces extending parallel to the longitudinal axis defined by said mounting plate.

4. A window lock for securing window sashes of a double hung window, the lock comprising: a housing positioned on one of said window sashes, a cam, said cam contained within said housing, a keeper positioned on the other of said windows configured to receive said cam therein, a handle, said handle positioned on said housing and attached to said cam for rotating the same, said housing defining a groove and a pair of slots, each slot including an orthogonal groove ledge configured to receive a separate side of a U-shaped mounting plate, said mounting plate comprising a rectangular planar section with a pair of friction ramps, said pair of ramps positioned atop said planar section, and a pair of opposing longitudinal ends relative to the mounting plate, each longitudinal end defining a rectangular cross-section and a pair of opposing lateral ends relative to said mounting plate, each lateral end having a planar terminal face, wherein corresponding planar terminal faces on each longitudinal end are coplanar and parallel, a downwardly extending biased face extending along a longitudinal axis defined by said mounting plate and terminating in a vertical part, and a shoulder, each shoulder extending completely between said opposing lateral ends and beyond said rectangular cross-sectional end, each of said slots shaped complementary to different ones of said biased faces of said mounting plate such that said mounting plate securely engages said housing.

5. The window lock of claim 4 further comprising the mounting plate defining an opening in one of said rectangular cross-sectional ends, a fastener, said fastener positioned in said opening to stabilize said mounting plate.

6. A method of locking a double hung window comprising the steps of:

a) providing the window lock of claim 1;

b) attaching the mounting plate to a window sash;

c) attaching the keeper to a window sash which is opposing the window sash with the mounting plate attached;

d) sliding the housing into engagement with the mounting plate, completely positioning the mounting plate within the housing; and e) rotating the handle to cause the cam to engage the keeper and lock the window.

7. The method of claim 6 further comprising the step of disengaging the cam from the keeper to unlock the window.

* * * * *